US005190374A

United States Patent [19]

Harms et al.

[11] Patent Number: 5,190,374

[45] Date of Patent: Mar. 2, 1993

[54] METHOD AND APPARATUS FOR CONTINUOUSLY MIXING WELL TREATMENT FLUIDS

[75] Inventors: Weldon M. Harms, Duncan; Thomas E. Allen, Comanche; Lewis R. Norman, Duncan, all of Okla.; Syed Hamid, Rijnsburg, Netherlands

[73] Assignee: Halliburton Company, Duncan, Okla.

[21] Appl. No.: 693,995

[22] Filed: Apr. 29, 1991

[51] Int. Cl.[5] ..... B01F 15/02

[52] U.S. Cl. ..... 366/165; 366/181

[58] Field of Search ..... 366/150, 154, 155, 156, 366/163, 164, 165, 167, 168, 169, 173, 176, 177, 179, 181, 182

[56] References Cited

U.S. PATENT DOCUMENTS

| | | | |
|---|---|---|---|
| 2,743,909 | 5/1956 | Lawlor | 259/42 |
| 4,014,527 | 3/1977 | Watson | 366/167 |
| 4,077,612 | 3/1978 | Ricciardi | 366/102 |
| 4,141,656 | 2/1979 | Mian | 366/162 |
| 4,184,771 | 1/1980 | Day | 366/3 |
| 4,336,145 | 6/1982 | Briscoe | 252/8.55 R |
| 4,453,829 | 6/1984 | Althouse, III | 366/13 |
| 4,466,890 | 8/1984 | Briscoe | 252/8.55 R |
| 4,643,582 | 2/1987 | Ricciardi | 366/165 |
| 4,764,019 | 8/1988 | Kaminski et al. | 366/15 |
| 4,772,646 | 9/1988 | Harms et al. | 524/27 |
| 4,779,186 | 10/1988 | Handke et al. | 364/172 |
| 4,828,034 | 5/1989 | Constien et al. | 166/308 |
| 4,830,505 | 5/1989 | Dunton et al. | 366/2 |
| 5,046,855 | 9/1991 | Allen | 366/65 |
| 5,114,239 | 5/1992 | Allen | 366/65 |

OTHER PUBLICATIONS

Bulletin 790 published in 1990 by Acrison, Inc.

Bulletin No. BJI-73-156 (undated) published by Byron Jackson Inc., a subsidiary of Borg-Warner in Houston, Texas.

An article entitled "Integrated, Solid-Liquid Mixing System Wets Out Powders Without Forming Lumps", Berenstain et al., published in *Chemical Processing*, Mar., 1989.

Undated brochure entitled "The Ram—Recirculating Averaging Mixer for Consistent Slurry Weight," published by BJ-Titan; Bulletin BJABZ002 of B. J. Hughes (undated) entitled DUAL RAM—Dual Recirculating Averaging Mixer.

Halliburton Sales & Service Catalog No. 43, published in 1985, p. 2416.

American Chemical Society Symposium Series 396, Oil Field Chemistry Enhanced Recovery and Production Stimulation, Section entitled "Dispersion of Gelling Agents", Chapter 2, pp. 72-74, Application of Chemistry in Oil and Gas Well Fracturing, 1989, written by Weldon M. Harms.

(List continued on next page.)

*Primary Examiner*—Robert W. Jenkins

*Attorney, Agent, or Firm*—Robert A. Kent; Nick Kennedy

[57] ABSTRACT

An apparatus and method for continuously mixing well treatment fluids, such as fracturing gels and the like. Dry polymer is fed into a metering feeder which accurately meters the rate of polymer fed into a water spraying mixer. A vent is provided so that air can enter with the polymer as necessary. Water, with or without a buffering compound therein, is flowed through a water inlet of the mixer. The water is jetted into a spiraling flow pattern through which the polymer falls and is substantially wetted. Auxiliary water inlets may be used to add additional water to the water-polymer slurry to increase mixing energy and increase the amount of slurry produced. The slurry is discharged into a mixing tank with an agitator and then into a holding tank. The slurry may also pass through a shear device to further increase the rate of viscosification of the slurry. In this way, the slurry may be continuously mixed on a real time basis while carrying out the well treatment operation, such as the fracturing of a formation.

12 Claims, 4 Drawing Sheets

OTHER PUBLICATIONS

Society of Petroleum Engineers Paper No. SPE 17535, "Diesel-Based Gel Concentrate Improves Rocky Mountain Region Fracture Treatments", presented at the SPE Rocky Mountain Regional Meeting, held in Casper, Wyoming, May 11-13, 1988.

Article entitled "Turbulent Mixing at High Dilution Ration in a Sulzer-Koch Static Mixer", published in Ind. Eng. Chem. Process Des. Dev. 1986.

Undated brochure TSL-5011, "Precision Meets Dependability for the Perfect Mix" published by Dowell-Schlumberger (undated).

"Western Offshore Cementing Service" (undated), published by The Western Company of North America.

Undated flyer MC0009, "The Magcobar Cementing System", Magcobar Division of Dresser Industries, Inc.

CPI, Nov.-Dec., 1983, an article entitled "Powder/Liquid Mixing—It's Not Really Magic".

"Feed System for Breaxit Polymers", demonstrated by representatives of Exxon Chemicals to employees of Halliburton Services on Apr. 4, 1989.

Undated Halliburton Services ads entitled "To those who've been trying to imitate Halliburton LGC systems for the past 11 years: Thanks for the compliment." and Oil-based LGC Systems—Two new ways to concentrate on wellsite economy. (undate).

Oil & Gas Journal—Technology, Jun. 6, 1988, article entitled "Continuous mix technology adds new flexibility to frac jobs".

Petroleum Engineer International, Apr., 1988, pp. 51-54.

SPE Production Engineering, Nov., 1989, "Study of Continuously Mixed Crosslinked Fracturing Fluids With a Recirculating Flow-Loop Viscometer".

Society of Petroleum Engineers Paper No. SPE 18968, "Viscosity Measurement Throughout Frac Job Gives Increased Gel Control During Continuous Mixing", prepared for presentation at SPE Joint Rocky Mountain Regional/Low Permeability Reservoirs Symposium & Exhibition, Denver, Colorado, Mar. 6-8, 1989.

METHOD AND APPARATUS FOR CONTINUOUSLY MIXING WELL TREATMENT FLUIDS

BACKGROUND OF THE INVENTION

1. Field Of The Invention

The present invention relates to mixing of polymer gel agents and water to form a well treatment fluid, such as a fracturing ("frac") gel or other similar gel, and more particularly, to a method and apparatus for continuously mixing such gels on a real time basis to achieve rapid hydration without the necessity of an oil-based fluid or the suspension agents normally associated therewith.

2. Description Of The Prior Art

Many treatments and procedures are carried out in industry utilizing high viscosity fluids to accomplish a number of purposes. For example, in the oil industry, high viscosity aqueous well treating fluids or gels are utilized in treatments to increase the recovery of hydrocarbons from subterranean formations, such as by creating fractures in the formation, acidizing the formations, etc. High viscosity aqueous fluids are also commonly utilized in well completion procedures. For example, during the completion of a well, a high viscosity aqueous completion fluid having a high density is introduced into the well to maintain hydrostatic pressure on the formation which is higher than the pressure exerted by the fluids contained in the formation, thereby preventing the formation fluids from flowing into the well bore.

High viscosity treating fluids, such as fracturing or acidizing gels, are normally made using dry polymer additives or agents which are mixed with water or other aqueous fluids at the job site. Such mixing procedures have some inherent problems, particularly on remote sites or when large volumes are required. For example, special equipment for mixing the dry additives with water is required, and problems such as chemical dusting, uneven mixing, lumping of gels while mixing and extended preparation and mixing time are involved. In addition, the mixing and physical handling of large quantities of dry chemicals require a great deal of manpower, and when continuous mixing is required, the accurate and efficient handling of dry chemicals is extremely difficult.

The lumping of gels occurs because the initial contact of the polymer with water results in a very rapid hydration of the outer layer of particles which creates a sticky, rubbery exterior layer that prevents the interior particles from contacting water. The net effect is formation of what are referred to as "gel balls" or "fish eyes". These hamper efficiency by lowering the viscosity achieved per pound of gelling agent and also by creating insoluble particles that can restrict flow both into the well formation and back out of it. Thus, simply mixing the untreated polymer directly with water is not a very successful method of preparing a smooth homogeneous gel free from lumps. A method directed to solving this problem is to control particle size and provide surface treatment modifications to the polymer. It is desired to delay hydration long enough for the individual polymer particles to disperse and become surrounded by water so that no dry particles are trapped inside a gelled coating to form a gel ball. This can be achieved by coating the polymer with materials such as borate salts, glyoxal, non-lumping HEC, sulfosuccinate, metallic soaps, surfactants, or other materials of opposite surface charge to the polymer.

One way to improve the efficiency of polymer addition to water and derive the maximum yield from the polymer is to prepare a stabilized polymer slurry (SPS), also referred to as a liquid gel concentrate (LGC). The liquid gel concentrate is premixed and then later added to the water. In U.S. Pat. No. 4,336,145 to Briscoe, assigned to the assignee of the present invention, a liquid gel concentrate is disclosed comprising water, the polymer or polymers, and an inhibitor having the property of reversibly reacting with the hydratable polymer in a manner wherein the rate of hydration of the polymer is retarded. Upon a change in the Ph condition of the concentrate such as by dilution and/or the addition of a buffering agent (Ph changing chemical) to the concentrate, upon increasing the temperature of the concentrate, or upon a change of other selected condition of the concentrate, the inhibition reaction is reversed, and the polymer or polymers hydrate to yield the desired viscosified fluid. This reversal of the inhibition of the hydration of the gelling agent in the concentrate may be carried out directly in the concentrate or later when the concentrate is combined with additional water.

The aqueous-based liquid gel concentrate of Briscoe has worked well at eliminating gel balls and is still in routine use in the industry. However, aqueous concentrates can suspend only a limited quantity of polymer due to the physical swelling and viscosification that occurs in a water-based medium. Typically about 0.8 pounds of polymer can be suspended per gallon of the concentrate.

By using a hydrocarbon carrier fluid, rather than water, higher quantities of solids can be suspended. For example, up to about five pounds per gallon of polymer may be suspended in a diesel fuel carrier. Such a liquid gel concentrate is disclosed in U.S. Pat. No. 4,722,646 to Harms and Norman, assigned to the assignee of the present invention. Such hydrocarbon-based liquid gel concentrates work well but require a suspension agent such as an organophylic clay or certain polyacrylate agents. The hydrocarbon-based liquid gel concentrate is later mixed with water in a manner similar to that for aqueous-based liquid gel concentrates to yield a viscosified fluid, but hydrocarbon-based concentrates have the advantage of holding more polymer.

An additional problem with prior methods using liquid gel concentrates occurs in offshore situations. The service vessels utilized to supply the offshore locations have a limited storage capacity and must therefore often return to port for more concentrate before they are able to do additional jobs, even when the liquid gel concentrate is hydrocarbon-based. Therefore, it would be desirable to be able to continuously mix a well treatment gel during the actual treatment of the subterranean formation from dry ingredients. For example, such an on-line system could satisfy the fluid flow requirements for large hydraulic fracturing jobs during the actual fracturing of the subterranean formation by continuously mixing the fracturing gel.

One method and apparatus for continuously mixing a fracturing gel is disclosed in U.S. Pat. No. 4,828,034 to Constien et al., in which a fracturing fluid slurry concentrate is mixed through a static mixer device on a real time basis to produce a fully hydrated fracturing fluid during the actual fracturing operation. This process utilizes a hydrophobic solvent which is characterized by a hydrocarbon such as diesel as in the hydrocarbon-based liquid gel concentrates described above.

Recently, however, there have been some problems with hydrocarbon-based liquid gel concentrates because some well operators object to the presence of these fluids, such as diesel, even though the hydrocarbon represents a relatively small amount of the total fracturing gel once mixed with water. Also, there are environmental problems associated with the clean-up and disposal of well treatment gels containing hydrocarbons. These hydrocarbon-related problems would also apply to the process of Constien et al. Accordingly, there is a need for a process to produce a well treatment gel in which relatively higher amounts of polymer per unit volume can be utilized while eliminating the environmental problems and objections related to hydrocarbon-based concentrates. There is also a need for this process to produce the well treatment gel substantially continuously during the well treatment operation to overcome the storage capacity problems discussed above.

The method and apparatus of the present invention provide a solution to these problems by providing a means for substantially continuously producing a fracturing gel without the use of hydrocarbons or suspension agents, while still avoiding gel balls, by feeding the polymer into an axial flow mixer which has high mixing energy to substantially wet all of the polymer during its initial contact with water. After initial mixing, additional water may be added to the mixer to increase the volume of water-polymer slurry produced thereby.

In the present invention, it is possible to use a non-coated (non-surface-treated) gelling agent. This provides a simpler and less expensive process, and the materials themselves are also cheaper because raw gelling agents are less expensive than coated or treated materials.

SUMMARY OF THE INVENTION

The apparatus and method of the present invention provide for real time mixing of well treatment fluids, such as fracturing gels, acidizing gels, fracture-acidizing gels, gravel packing gels, weighted gels, or the like, from powdered polymer solids in real time. This on-line system may be used in oil field applications and eliminates conventional large volume mixing tanks yet satisfies the fluid flow requirements for well treatment processes such as large hydraulic fracturing jobs during the actual fracturing of the subterranean formation. With the present invention, full hydration of the polymer and optimum viscosity of the well treatment fluid may be achieved in a relatively short time while avoiding the formation of gel balls.

The preferred method of hydrating a polymer to produce a well treatment fluid or gel comprises the steps of providing a predetermined quantity of the hydratable polymer in a substantially particulate form to a polymer or solids inlet of a water spraying mixer, supplying a stream of water to a water inlet of the mixer, and mixing the polymer in water in the mixer, thereby wetting substantially all of the solid polymer particles to form a water-polymer mix prior to discharge from the mixer. The step of providing a predetermined quantity of polymer preferably comprises adding bulk polymer to a metering feeder and accurately supplying the predetermined quantity of polymer from the feeder to the mixer. The metering feeder preferably comprises a metering auger which rotates at a controlled speed, thereby discharging the predetermined quantity of polymer therefrom at the desired rate.

The polymer particles may be treated with a hydration-delaying coating, in which case the method further comprises the step of adding a buffering compound or other suitable agent to the stream of water for chemically reversing the coating. Preferably, the buffering compound is added to the stream of water prior to entry of the stream of water into the water spraying mixer. This eliminates the previously known step of mixing the buffering agent with a previously dispersed gelling agent. Thus, in this embodiment, the method of hydrating a polymer of the present invention may be said to comprise the steps of supplying a quantity of coated polymer to a mixer, supplying a quantity of buffered water to the mixer for substantially completely wetting the coated polymer, and discharging the wetted water-polymer mix or slurry from the mixture substantially without lumping. A step of supplying an additional quantity of buffered water to the mixer after initial contact of the coated polymer with the first mentioned quantity of buffered water may be added, thereby increasing the volume of the mixture.

Supplying the polymer preferably comprises the steps of feeding bulk polymer to the metering feeder, and discharging an accurately controlled predetermined quantity of polymer from the feeder to the mixer. The polymer may be supplied without a suspension agent.

The method of the present invention further comprises flowing the slurry or mix through a high shear device after it is discharged from the mixer for increasing the rate of viscosification of the mix.

The method may also comprise the step of providing an air inlet opening for preventing formation of a vacuum in the feeder.

The method may further comprise discharging the water-polymer mix from the mixer into a tank and agitating the mix in the tank.

The apparatus of the present invention in a preferred embodiment comprises the metering feeder, the discharge of which is connected to the polymer inlet of the mixer. This connection may be made by a tee wherein one of the tee connections is left open so that air can enter the system. A water supply is connected by a water line to the water inlet of the mixer. The buffer may be injected into this water line. The mixer is preferably mounted adjacent to the upper portion of a mixing or primary tank, and an agitator may be provided in the mixing tank to further agitate and stir the slurry. The slurry may be transferred from the mixing tank to a holding or secondary tank after which it is discharged to the fracturing process. The high shear device may be disposed in the holding tank. A pump may be used for transferring the slurry from the mixing tank to the holding tank.

One embodiment of the water spraying mixer is an axial flow mixer substantially identical to that disclosed in prior U.S. patent application Ser. No. 07/412,255, assigned to the assignee of the present invention and incorporated herein by reference. This prior art mixer has been used for mixing cement, and in this embodiment, two additional ports in the mixer are used for recirculating the slurry. In the present invention, these ports are used as additional inlets branched from the main water line, thereby providing a means for directing additional water to the mixer after the polymer is first contracted by water in the mixer. This increases the mixing energy within the mixer and provides an increased volume of water-polymer mix.

The mixer comprises a valve means for controlling the amount of water entering the mixer through the main water inlet and further comprises a means for directing the water in a substantially spiralling flow which wets the polymer as it falls through the mixer.

It is an important object of the present invention to provide a method of rapid hydration of polymer when the polymer is added to water to produce a viscous well treatment fluid, such as a fracturing gel, gravel packing fluid, viscous acidizing gel, or similar fluid.

It is another object of the invention to provide a method of rapid hydration of polymer in producing a viscous fluid in an on-line real time basis by continuously producing the fluid during a well treatment process.

It is an additional object of the invention to provide a method and apparatus of producing a viscous fluid such as fracturing gel while eliminating the need to batch-mix the polymer in large volume tanks, although the method can be used to prepare batches of gel to be held in storage tanks.

It is a further object of the invention to provide a method and apparatus for producing a fracturing gel and eliminate the formation of gel balls without requiring the production of an aqueous-based or hydrocarbon-based liquid gel concentrate.

Still another object of the invention is to provide a method and apparatus for mixing a polymer with water utilizing a water spraying mixer.

Another object of the invention is to provide a method and apparatus for rapidly hydrating a non-coated or non-surface treated gelling agent without necessarily adding a buffering agent.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIG. I presents a schematic of the apparatus of the present invention for continuously mixing polymers with water.

DESCRIPTION OF THE PREFERRED EMBODIMENT

Figure 1:
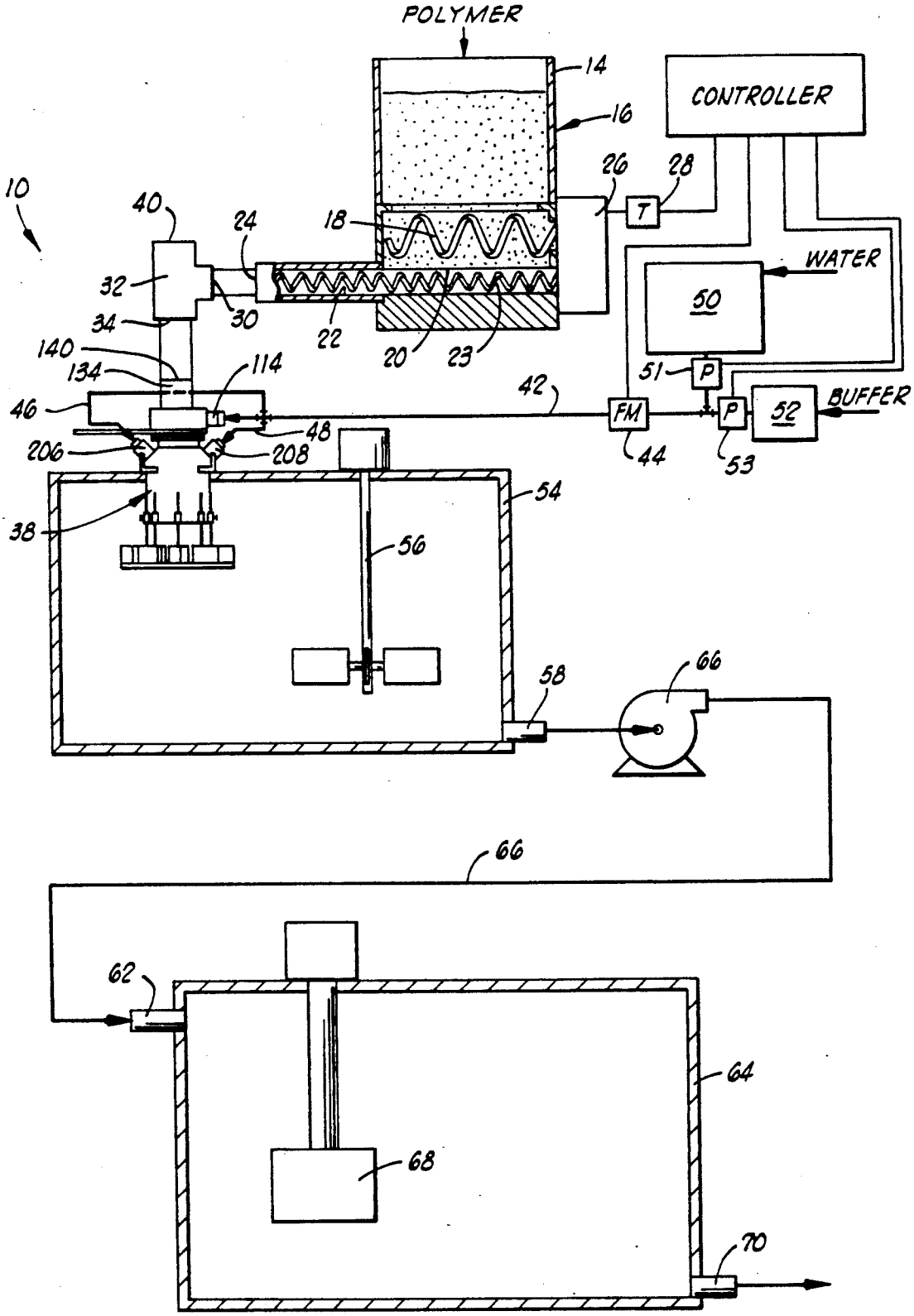

Referring now to the drawings, and more particularly to FIG. 1, the apparatus for continuously mixing well treatment gels or similar fluids of the present invention is shown and generally designated by the numeral 10.

The polymer is introduced into the system by pouring it in bulk form into a hopper portion 14 of a feeder 16. Feeder 16 is preferably of a type which discharges an accurately metered quantity of polymer over time. The feeder illustrated is a metering feeder, such as an Acrison feeder. It should be understood, however, that the invention is not intended to be limited to this particular Acrison feeder. The important feature is that a device be used which provides an accurately metered quantity of polymer discharged therefrom.

The Acrison feeder has a large conditioning auger or agitator 18 adjacent to the bottom of hopper 14. Conditioning auger 18 of this prior art feeder "conditions" or stirs the polymer and breaks up any clumps of polymer that might be stuck together. After being stirred by conditioning auger 18, the polymer falls through an opening 20 into a feed chamber 22. A smaller metering auger 23 rotates within chamber 22, and the polymer is discharged from feeder 16 through an outlet 24. In the Acrison feeder, conditioning auger 18 and metering auger 23 rotate at dissimilar speeds. A control box 26 drives conditioning auger 18 and metering auger 23. A speed transducer 28 may be engaged with control box 26.

Outlet 24 of feeder 16 is connected to branch 30 of tee 32. In a preferred embodiment, one end 34 of the run of tee 32 is connected to polymer inlet 36 of a high shear flow mixer 38, the details of which will be further discussed herein. Mixer 38 is preferably a water spraying device. In operation, mixer 38 can draw a vacuum in feeder 16 if not vented, so the opposite end 40 of the run of tee 32 is open to the atmosphere to allow the entry of air as necessary.

A water line 42 is connected to a water inlet 114 of mixer 38. Water line 42 may include a flow meter 44, such as a Halliburton turbine flow meter. Water line 42 is also connected by branches 46 and 48 to additional or auxiliary water inlets 206 and 208, respectively. Water may be supplied to water line 42 from a water tank or reservoir 50, or the water supply may be connected directly to the water line. A pump 51 may be used to pump from reservoir 50 as necessary.

A buffering compound or any other desired additive may also be introduced to water line 42 through a metering means 52. A pump 53 may be used as necessary to pump the buffering compound or other additive. When a buffer is required, the compound preferably is thus introduced or injected directly into the system with the water.

A controller 55 may be connected to speed transducer 28, flow meter 44, and pumps 51 and 53, thus providing a feedback means for controlling the flow rates of the polymer, water and any buffering compound or other additives. In this way, the polymer/water concentration and throughput are controlled.

Mixer 38 is mounted to the upper portion of a mixing tank or tub 54. Mixing tank 54 may also be referred to as primary tank 54. As will be further discussed herein, the wetted polymer will be discharged from mixer 38 as a water-polymer mix or slurry into mixing tank 54. The slurry in mixing tank 54 may be further stirred by an agitating means 56 of a kind generally known in the art, although this may not be necessary. The agitating means may be characterized as any known type of fluid shear device.

The slurry is discharged from mixing tank 54 through an outlet 58 and flows through a slurry line 60 to inlet 62 of a holding tank 64. Holding tank 64 may also be referred to as secondary tank 64. The slurry may flow by gravity, but generally, a pumping means, such as centrifugal pump 66 will be installed in slurry line 60 to move the slurry. Pump 66 may also be described as a shear device 66 which applies shear to the fluid.

In one embodiment, the fluid passes through another shear device 68. It is well known that applying shear to the fluid will increase hydration and reduce the time necessary for the fluid to reach its maximum viscosity. Therefore, when time is a critical factor, shear device 66 and/or 68 may be necessary. The slurry will eventually reach its maximum viscosity after a certain period of time anyway, and if time is not critical, such as when the fluid is held for a lengthy period in holding tank 64, then shear devices 66 and/or 68 may be eliminated. Shear device 68 may be any device which provides a high shear to the fluid. Examples of such high shear devices include, but are not limited to, centrifugal pumps, rotating turbine paddles, static flow mixers or the like. These devices may be used singly, in series, and/or in combination.

The fluid is discharged from holding tank 64 through an outlet 70, and the fluid then flows to other devices known in the art and then to the well. For example, fluid flowing from outlet 70 of holding tank 64 may enter a fracturing blender which mixes sand with the slurry. Such downstream devices are known in the art and are therefore not illustrated in FIG. 1.

Figure 2:
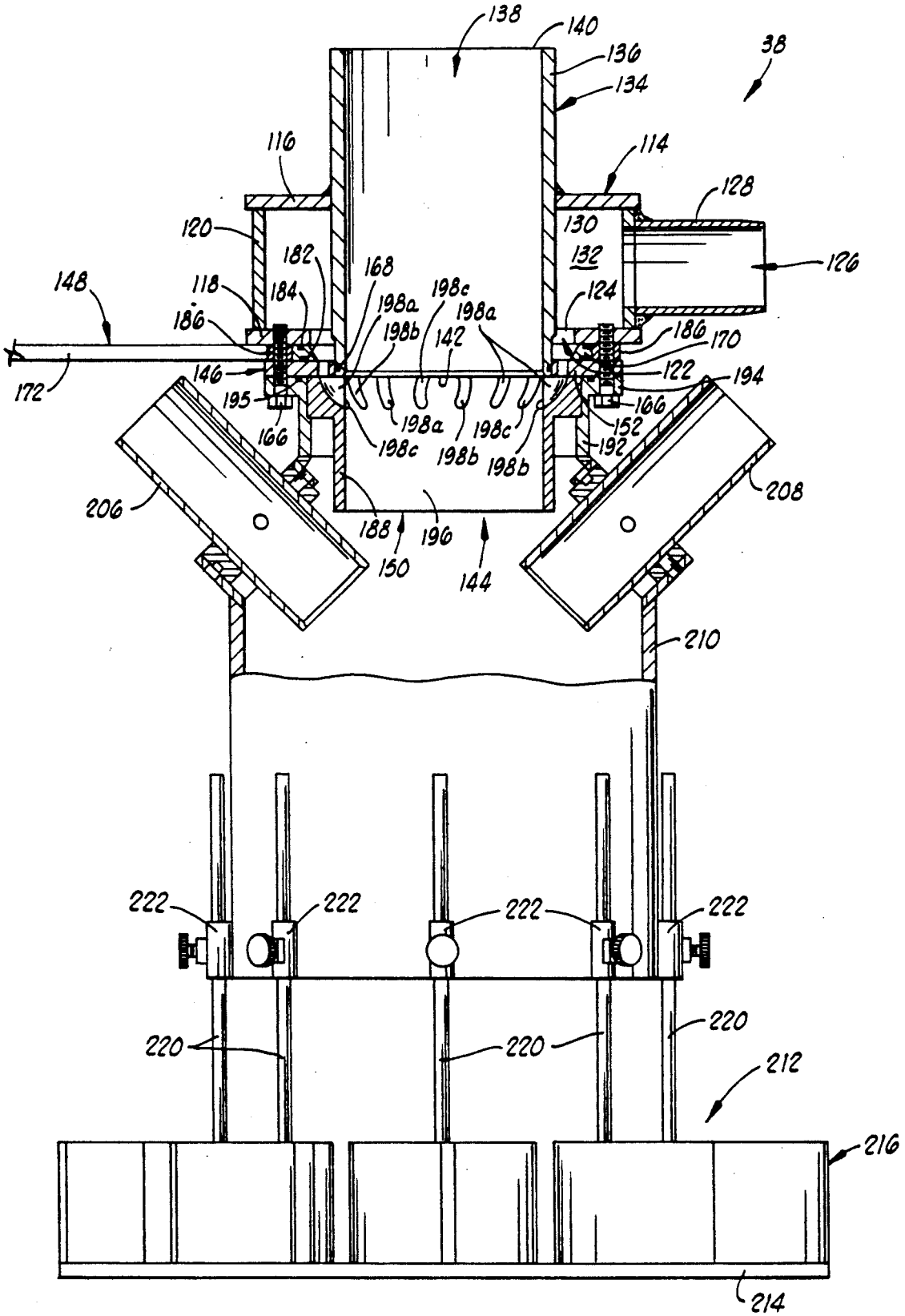
FIG. 2 is a partially cross-sectional and partially elevational view of the water spraying mixer used in the present invention.

Referring now to FIG. 2, the details of water spraying mixer 38 will be discussed. This description of mixer 38 is substantially the same as that presented in prior U.S. patent application Ser. No. 07/412,255 which has already been incorporated herein by reference. Mixer 38 is illustrated as an axial flow device which conveys the polymer axially from the inlet to the outlet thereof. That is, there are no elbows or horizontal conduits through which the polymer must be conveyed during its mixing with water prior to being discharged into mixing tank 54.

Water inlet 114 of mixer 38 is characterized as a water inlet member 114 or water inlet manifold 114. Water inlet manifold 114 includes an annular top plate 116, an annular bottom plate 118 having a central opening with a larger diameter than the central opening of the plate 116, and a cylindrical side wall 120 connected, such as by welding, to and between top plate 116 and bottom plate 118. These components are disposed relative to each other as shown in FIG. 2 so that an axial opening 122 is defined. The bottom of axial opening 122 provides an exit port 124 through which the water received by water inlet manifold 114 flows in a downward path prior to mixing with the polymer. This water is received through an entry port or inlet 126 defined by a horizontal sleeve 128 connected to side wall 120 in communication with an opening 130 defined therein. Exit port 124 communicates with entry port 126 through an annular interior region 132 defined by the connection of water inlet member 114 with polymer inlet 134, which is received in axial opening 122. Polymer inlet 134 is characterized as a polymer inlet member 134 which is connected to water inlet manifold 114 by any means known in the art such as by welding.

Polymer inlet member 134 may also be referred to as sleeve 134 which has a cylindrical wall 136 defining an axial passageway 138 between top and bottom ends 140 and 142 of the sleeve. Top end 140 is connectable to tee 32 as previously described so that sleeve 134 receives polymer through top end 140 and directs it in a downward flow through bottom end 142. In particular, sleeve 134 provides a straight flow path for the polymer between tee 32 and bottom end 142 of sleeve 134 where the polymer enters a valve 144 of mixer 38.

Valve 144 meters the water to be mixed with dry polymer coming from sleeve 134. Valve 144 includes an orifice plate 146, a valve plate 148 and means 150 for jetting water into admixture with the polymer. The illustrated design of orifice plate 146 contains eighteen orifices or holes, and valve plate 148 is designed so that it opens six of the eighteen orifices first and then an additional six holes as valve plate 148 is further rotated and ultimately the final six holes are opened upon further rotation, although the number and sizes of holes may vary. This design allows a maximum hole dimension or passage diameter for a given flow rate as compared to a system which may have the entire passageway opening simultaneously. This controlled opening is important for contaminate passage which could block metering orifices. In some applications, adjustable water flow may not be required. In such cases, valve plate 148 may be eliminated.

The mixing water, as it exits orifice plate 146, flows in an axial direction and is subsequently turned and directed toward the polymer flow path coming from sleeve 134. This turning of the water flow direction is produced by the jet means 150 which in the preferred embodiment has grooves coinciding with the orifice plate 146 orifices. Thus, jet means 150 changes the direction of the mixing water from axially downward to slightly tangential and downward. This produces a downwardly spiraling column of fluid circulating about an open center or iris. In a preferred embodiment, the depths of the grooves of jet means 150 are staggered so that with high flow rates, backflow up passage 138 is prevented.

Figure 3:
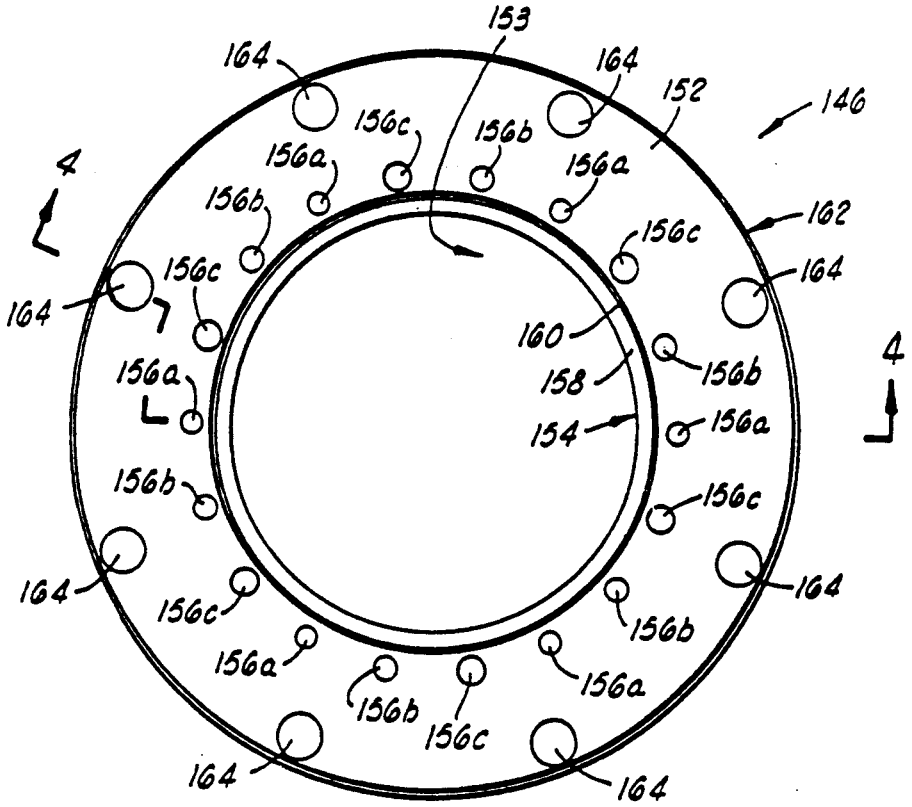
FIG. 3 is a plan view of an orifice plate of a valve of the mixer shown in FIG. 2.
Figure 4:
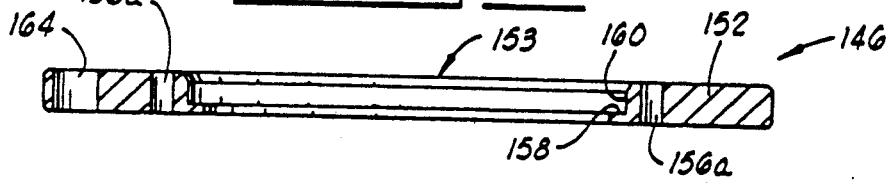
FIG. 4 is a cross-sectional view taken along lines 4—4 in FIG. 3.

Referring now also to FIGS. 3 and 4, orifice plate 146 includes an annular member 152 having a central opening 153 defined by an inner periphery 154 about which the plurality of orifices 156 is defined. The orifices of the preferred embodiment include three sets of differently sized orifices **156*a*, 156*b*, 156*c*. Each set includes six orifices of the same size. In the illustrated embodiment, the orifices 156*a* have the smallest diameter, orifices 156*b* have a larger diameter, and the orifices 156*c* have the largest diameter of the three sets. These are spaced sequentially and equiangularly around the inner periphery 154 as best seen in FIG. 3**. The orifices can be the same size or of different sizes and different arrangements.

Also defined about inner periphery 154 is a notch or shoulder defined by an annular surface 158 and an adjoining, perpendicularly extending cylindrical surface 160.

Annular member 152 also has an outer periphery through which holes 164 are defined. Holes 164 receive retaining bolts 166, two of which are shown in FIG. 2, extending through spacers 186.

When orifice plate 146 is connected to water inlet manifold 114 by the retaining bolts 166, orifices 156 are disposed below exit port 124 of water inlet manifold 114. Orifice plate 146 is also concentrically disposed about inlet sleeve 134. A seal ring 168 seals orifice plate 146 and inlet sleeve 134. Thus, orifice plate 146 is disposed below and adjacent to valve plate 148.

The disposition of valve plate 148 concentrically about inlet sleeve 134 adjacent to exit port 124 of water inlet manifold 114 is shown in FIG. 2. As disposed, valve plate 148 is pivotably connected to orifice plate 146 so that the position to which valve plate 148 is pivoted determines which of orifices 156 are open to pass liquid. The overall construction of valve plate 148 is more clearly shown in FIGS. 5 and 6. The preferred embodiment of valve plate 148 includes a ring 170 from which an actuating arm 172 extends radially outwardly. Arm 172 can be engaged by a suitable actuating device (not shown).

Figure 5:
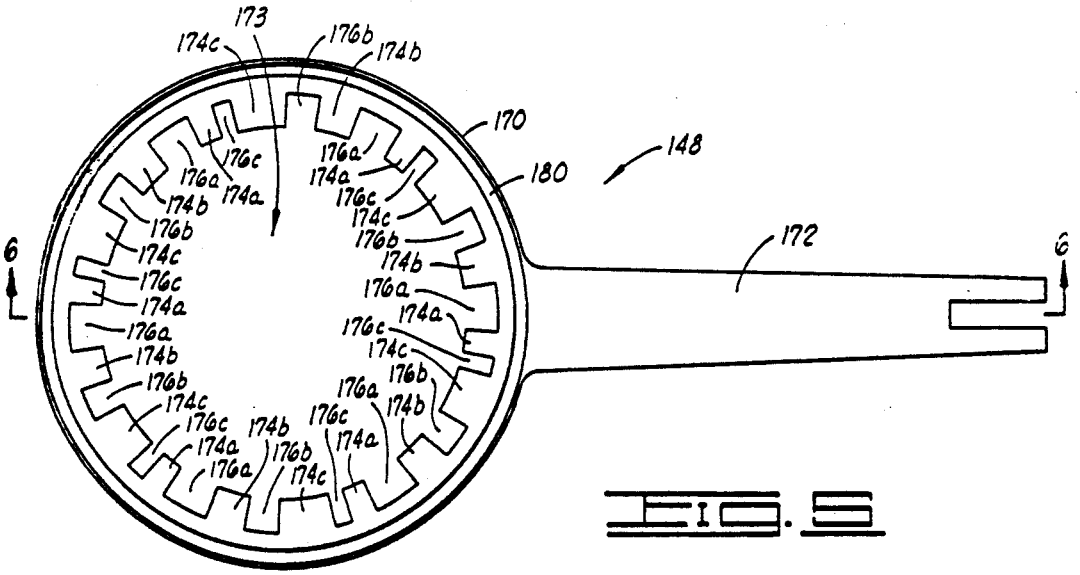
FIG. 5 is a plan view of a valve plate of the valve of the mixer.
Figure 6:
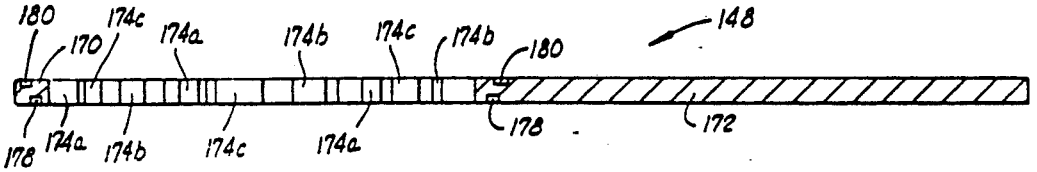
FIG. 6 is a cross-sectional view taken along lines 6—6 in FIG. 5.

Ring 170 has an outer periphery from which arm 172 extends. Ring 170 also includes a central opening 173 defined by an inner periphery which has a notched or toothed configuration as most clearly seen in FIG. 5. This configuration includes a set of teeth 174*a*, a set of teeth 174*b* and a set of teeth 174*c*. Each of the teeth within a respective set has the same width, and the width of each of teeth 174*c* is larger than the width of each of teeth 174*b*. Each of teeth 174*b* has a width larger than the width of each of teeth 174*a*. This sizing corresponds to the different size orifices 156*a*, 156*b*, 156*c* of orifice plate 146 and the desired sequencing for opening orifices 156*a*, 156*b*, 156*c*. Thus when water metering valve 144 is fully closed, each of teeth 174*a* overlies a respective orifice 156*a*, each of teeth 174*b* overlies a respective orifice 156*b*, and each of teeth 174*c* overlies a respective orifice 156*c*. This position is obtained by pivoting valve plate 148 counterclockwise as shown in FIG. 5 or outwardly from the page as shown in FIG. 2. The next respective bolt 166 limits rotation of valve plate 148 in this direction.

The sets of orifices 156*a*, 156*b*, 156*c* are progressively opened as actuating arm 172 of valve plate 148 is moved clockwise for the orientation shown in FIG. 5 or into the page for the orientation shown in FIG. 2. This direction of rotation is limited when actuating arm 172 abuts the corresponding bolt 166. Opening of an orifice 156*a*, 156*b*, 156*c* occurs when a corresponding aperture or space 176*a*, 176*b*, 176*c* defined between teeth 174*a*, 174*b*, 174*c* overlies or registers with the respective orifice of inner periphery 154 of orifice plate 146. Thus these elements of valve plate 148 define means for simultaneously opening orifices 156*a*, 156*b*, 156*c* of a respective set in response to pivotation of valve plate 148. In the preferred embodiment, the sequence of opening orifices 156 is such that an overlap exists. For example, the set of orifices 156*b* starts to open before the set of orifices 156*a* is fully open. This overlap makes the flow area versus position much smoother, and it can be made to approximate a straight line response if desired.

Within the body of ring 170 there are defined two grooves 178 and 180. Groove 178 is in a surface of ring 170 facing orifice plate 146, and groove 180 is in a surface of ring 170 facing opposite or away from orifice plate 146. These receive seals, such as O-rings 182 and 184, respectively, as shown in FIG. 2 to seal against the top surface of orifice plate 146 and the bottom surface of water inlet manifold 114, respectively. Seal groove 180 has a greater diameter than seal groove 178, thus the groove 180 encompasses a greater area of valve plate 148 than is encompassed by groove 178. The pressure which exists during operation acts on the greater upper surface area of valve plate 148 sealed by seal 184 to bias valve plate 148 downwardly against orifice plate 146, thereby minimizing leakage between orifice plate 146 and valve plate 148.

Valve plate 148 is retained in position by its concentric positioning with inlet sleeve 134. This maintains openings 153 in orifice plate 146 aligned with openings 173 in valve plate 148. However, it permits valve plate 148 to be moved relative to orifice plate 146 so that apertures 176 of valve plate 148 can be selectably registered with orifices 156 of orifice plate 146 to control the flow of the water received from exit port 124 of water inlet manifold 114 for mixing with the polymer axially received through axial passageway 138 of sleeve 134.

The above-described orifice plate 146 and valve plate 148 are designed in the preferred embodiment to provide a valve through which fluid can be flowed at a constant velocity for different volumetric flow rates. As used herein, "constant velocity" does not mean absolutely no velocity difference, but rather the term encompasses small velocity differences which are not significant for practical purposes to which the invention is put.

As shown in FIG. 2, liquid jet means 150 is disposed adjacent to bottom end 142 of inlet sleeve 134 and in communication with orifice plate 146. Liquid jet means 150 directs water into a circulating flow path as the water from inlet manifold 114 is passed through orifice plate 146 so that the downward flow of the polymer from polymer inlet sleeve 134 mixes with the water in the circulating flow.

In the preferred embodiment of jet means 150 shown in FIGS. 2 and 7–10, the circulating flow is caused by the construction of jet means 150 which includes an axial body 188 having a plurality of grooves 198 defined therein for directing streams of the water exiting orifices 156 with which apertures 176 of valve plate 148 register so that the directed streams form a flow circulating about an axis 190 of axial body 188. See FIG. 8. Axis 190 is aligned with the axis of inlet sleeve 134 so that axial body 188 is coaxially related to inlet sleeve 134. This relationship is maintained, and axial body 188 is connected to the previously described assembly of mixer 38, by means of a retaining collar 192 having a flange 194 which carries an O-ring 195 and through which retaining bolts 166 extend as shown in FIG. 2.

Axial body 188 of the preferred embodiment is a flanged sleeve wherein the flange is engaged by collar 192 as shown in FIG. 2. The sleeve includes an interior surface 196 in which the plurality of grooves 198 are defined at the flanged end which is secured adjacent to bottom end 142 of inlet sleeve 134, from which the sleeve of axial body 188 forms an extension. Surface 196 defines an axial passageway through axial body 188. This axial passageway is aligned with central openings 153 and 173 of orifice plate 146 and valve plate 148.

Grooves 198 defined in interior surface 196 are of three sizes and orientations to correspond to the orifices 156*a*, 156*b* and 156*c* overlaying and aligned and registering with the grooves. The grooves of these three sets are respectively identified by the reference numerals 198*a*, 198*b*, 198*c*. The shape of each of these is more clearly shown in FIGS. 8–10. Each of the grooves is formed at an angle to a radius of the cylindrical shape of axial body 188. Each group of grooves 198 angles downwardly from a semicircular opening at the top in a manner which is oblique to axis 190. In a preferred embodiment, the groove depths are staggered in sequential sets wherein each of three grooves within a set extends to a different depth (e.g., sequentially deep, deeper, deepest). With high flow rates, this prevents backflow up passage 138 15 resulting from flow interference.

Figure 7:
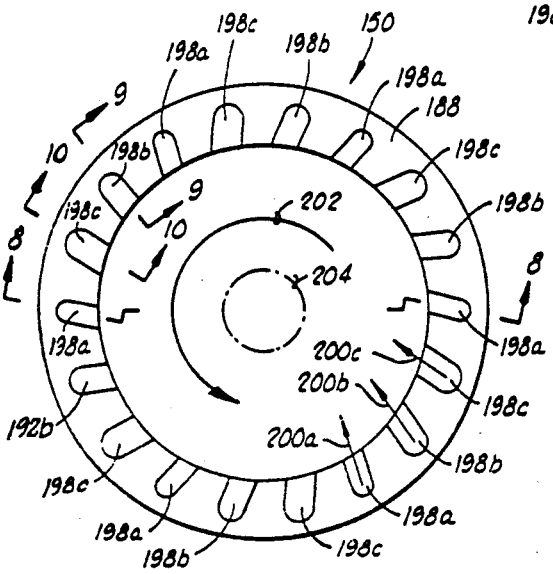
FIG. 7 is a plan view of a water jet member of the valve of the water spraying mixer.
Figure 8:
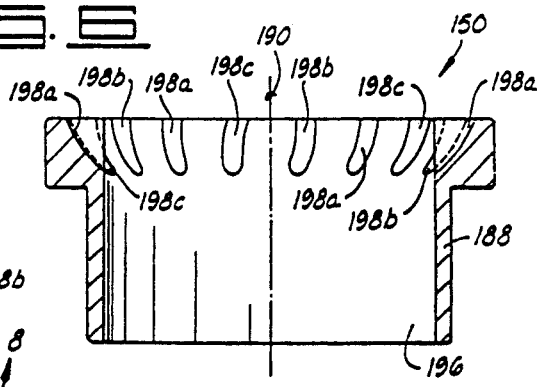
FIG. 8 is a cross section taken along lines 8—8 in FIG. 7.
Figure 9:
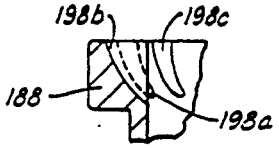
FIG. 9 is a cross-sectional view of a corner of the water jet member taken along lines 9—9 in FIG. 7.
Figure 10:
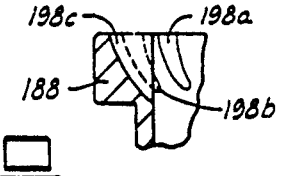
FIG. 10 presents a cross section of a part of the water jet member taken along lines 10—10 in FIG. 7.

As a result of the orientation of grooves 198, the water received by the grooves is not angled directly downwardly or at axis 190; rather, the water is directed at an angle as indicated by arrows 200*c*, 200*b*, 200*c* in FIG. 7. The result of this angular directing of the flow is to create a downwardly spiraling flow as indicated by the arrow 202 in FIG. 7. This forms a void 204, sometimes referred to as an iris, about axis 190.

As a result of the aforementioned construction and operation of orifice plate 146, valve plate 148 and liquid jet means 150, valve 144 has a reduced susceptibility to clogging by particles in the mix water, it has a relatively fast opening response time, and it can be tailored to achieve different gains via the different orifice sizes in orifice plate 146. This construction and operation also provides a single source of water control which permits easier manual or automatic control (i.e., only valve plate 148 needs to be operated for water control). It also communicates more water energy from the same size pumps which have been used with prior systems. The downwardly spiraling flow created within jet means 150, wherein open iris 204 is formed, helps separate entrained air from the water/polymer mixture and helps break up the polymer.

As further shown in FIG. 2, additional or auxiliary inlets 206 and 208 of mixer 38 are characterized as inlet sleeves 206 and 208 which are substantially diametrically opposed and skewed towards the same direction as water jetting grooves 198 of jet means 150. That is, as illustrated in FIG. 2 inlet sleeves 206 and 208 are disposed in a downward direction and at a slightly tangential angle to create a circular flow pattern. Thus, the water flowing through inlet sleeves 206 and 208 enters the circulating flow below jet means 150 in the same direction of circulation. Inlet sleeves 206 and 208 are connected to axial body 188 of jet means 150 by a containment body or housing 210 as shown in FIG. 2. Containment body 210 extends below jet means 150.

The use of at least two additional or auxiliary inlets 206 and 208 allows a larger volume of water-polymer slurry or mix to be formed. For example, a typical maximum rate in a prior system is 8–10 barrels per minute, whereas up to approximately 35 barrels per minute can be formed with the present invention. This increased volume and flow rate provides greater mixing energy within mixer 38 which improves wetting and breaking up of the dry material.

Figure 11:
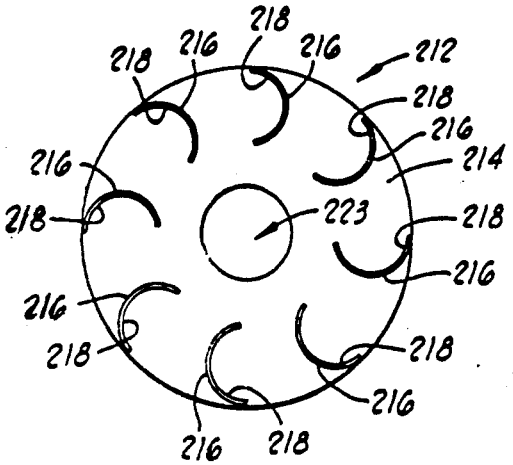
FIG. 11 is a plan view of a diffuser of the mixer shown in FIG. 2.

Mixer 38 further comprises diffuser means 212 for diffusing the circulating, downwardly spiraling flow below containment body 210 at the bottom of mixer 38. Refer also to FIG. 11. The circulating flow is diffused by engaging diffuser means 212 whereupon the flow changes its direction of flow. Diffuser means 212 is a member which includes a washer-shaped or annular plate 214 to which a plurality of baffle plates 216 are connected. Each of baffle plates 216, also called baffles or vanes 216, includes a concave surface 218 for receiving the circulating flow and changing its direction. Baffle plates 216 are connected to annular plate 214 at equally spaced intervals. Although not shown, diffuser means 212 may include a top plate to prevent or reduce vertical splashing.

Diffuser means 212 is connected to axial body 188 of jet means 150 by containment body 210 and an adjustment means for adjusting the distance diffuser means 212 is disposed below containment body 210. As shown in FIG. 2, the adjustment means includes a plurality of rods 220. The lower ends of rods 220 are attached to diffuser means 212; their upper ends are slidably received in thumbscrew brackets 222 attached to the lower end of containment body 210. The adjustment means permits diffuser means 212 to be adjusted to the surface of the body of the slurry when mixer 38 is disposed on the mixing tank 54 as illustrated in FIG. 1.

The outside diameter of diffuser means 212 is larger than the diameter of containment body 210. Diffuser means 212 has a hole 223 in the center. Baffles 216 are mounted in a direction such that the direction of rotation of the slurry as it exits the lower housing of mixer 38 defined by containment body 210 is reversed, thereby aiding in energy dissipation.

Diffuser means 212 dissipates energy at the surface of the body of the slurry when mixing tank 54 is up to its full operating capacity. This dissipation of energy helps reduce air entrainment. Having the slurry impact diffuser means 212 also helps mixing.

In the operation of mixer 38, as polymer is gravity fed or otherwise introduced through inlet sleeve 134, it first encounters the high velocity mixing water jets created within jet means 150. The flow of the mixing water at this point is controlled by operation of valve plate 148. Even at low water rates, most of the passageway through axial body 188 of jet means 150 is covered by the mixing water. Thus, it is difficult for the polymer to pass the initial mixing water section without being wetted by water. The mixture of polymer and water exiting the end of axial body 188 of jet means 150 is intersected by the jets of water flowing from auxiliary inlet sleeves 206 and 208. Through this two-stage high velocity mixing, the slurry circulating down the containment housing 210 is thoroughly mixed and homogeneous.

It will be seen, therefore, that the method and apparatus of the present invention for continuously mixing fracturing gels and the like are well adapted to carry out the ends and advantages mentioned as well as those inherent therein. While the presently preferred embodiment has been shown for the purposes of this disclosure, numerous changes in the arrangement and construction of parts may be made by those skilled in the art. All such changes are encompassed within the scope and spirit of the appended claims.

What is claimed is:

1. A method of hydrating a polymer to produce a well treatment gel, said method comprising the steps of:

providing a predetermined quantity of a hydratable polymer in a substantially particulate form, said polymer having a hydration-delaying coating, to a solids inlet of a water spraying mixer;

supplying a stream of water to a water inlet of said mixer;

adding a buffering compound to said stream of water for breaking down said coating on said polymer; and mixing said polymer and water in said mixer, said mixer comprising means for directing said water in a substantially spiralling flow within said mixer, thereby wetting substantially all of the polymer particles to form a water-polymer mix prior to discharge from said mixer.

2. The method of claim 1 wherein said buffering compound is added to said stream of water prior to entry of said stream of water into said mixer.

3. The method of claim 1 wherein said step of providing a predetermined quantity of polymer comprises:

adding bulk polymer to a metering feeder; and accurately supplying said predetermined quantity of polymer from said feeder to said mixer.

4. The method of claim 3 wherein said mixer is an axial flow mixer.

5. The method of claim 1 further comprising the step of providing an air inlet opening for preventing formation of a vacuum in said feeder.

6. The method of claim 1 wherein said mixer comprises valve means for controlling the amount of water entering said mixer.

7. The method of claim 1 further comprising means for directing additional water to said mixer after said polymer is first contacted by water, thereby increasing mixing energy within said mixer and providing an increased volume of water-polymer mix.

8. The method of claim 1 further comprising flowing said water-polymer mix discharged from said mixer through a shear device for increasing the viscosification of said mix.

9. The method of claim 1 further comprising the steps of:

discharging said water-polymer mix from said mixer into a tank; and agitating said mix in said tank.

10. A method of producing a well treatment gel comprising the steps of:

supplying a quantity of polymer having a hydration-delaying coating thereon to a metering feeder;

discharging a metered quantity of said polymer from said feeder into a water spraying mixer, said mixer comprising means for directing water in a substantially spiralling flow within said mixer;

continuously mixing buffered water with said polymer supplied to said mixer whereby said coating is broken down and thereby providing a substantially continuous discharge from said mixer of a buffered water-polymer slurry wherein said polymer is substantially completely wetted; and discharging said slurry from said mixer into a tank.

11. The method of claim 10 wherein said polymer is supplied to said mixer without a suspension agent.

12. The method of claim 10 further comprising the step of flowing said slurry through a high shear device for increasing viscosification of said slurry.

* * * * *